US008646998B2

(12) United States Patent
Tanaka

(10) Patent No.: US 8,646,998 B2
(45) Date of Patent: Feb. 11, 2014

(54) CORE HOLDING STRUCTURE AND PRINTER

(75) Inventor: Takuya Tanaka, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 113 days.

(21) Appl. No.: 13/448,546

(22) Filed: Apr. 17, 2012

(65) Prior Publication Data

US 2013/0272766 A1 Oct. 17, 2013

(51) Int. Cl.
*B65H 75/00* (2006.01)

(52) U.S. Cl.
USPC ..... 400/242; 400/613

(58) Field of Classification Search
USPC ..... 400/422
See application file for complete search history.

(56) References Cited

U.S. PATENT DOCUMENTS 5,138,335 A * 8/1992 Sugimoto et al. ..... 347/215
5,447,379 A * 9/1995 Pou ..... 400/88
5,718,524 A * 2/1998 Nordstrom et al. ..... 400/248
5,860,753 A * 1/1999 Beck et al. ..... 400/692
5,915,860 A * 6/1999 Laurent ..... 400/242
6,261,013 B1 * 7/2001 Bryer et al. ..... 400/613
6,536,696 B2 * 3/2003 Fiutak et al. ..... 242/358.1
6,874,958 B1 * 4/2005 Panebianco et al. ..... 400/243
7,441,971 B2 * 10/2008 Pomfret ..... 400/242
2006/0159504 A1 * 7/2006 Blanchard et al. ..... 400/120.16

FOREIGN PATENT DOCUMENTS

JP 09-315691 12/1997

* cited by examiner

*Primary Examiner* — Anthony Nguyen
(74) *Attorney, Agent, or Firm* — Turocy & Watson, LLP

(57) ABSTRACT

A core holding structure includes a shaft portion in which a core for winding thereon a strip-shaped material is inserted and by which the core is rotationally driven. A roller is provided on an outer circumferential surface of the shaft portion. The roller is configured to make contact with an inner circumferential surface of the core inserted in the shaft portion and rotate in a direction in which the core is attached to or detached from the shaft portion. The core holding structure further includes an elastic member configured to hold the roller and bias the roller radially outwards from the shaft portion when pressed toward the surface of the shaft portion.

10 Claims, 7 Drawing Sheets

CORE HOLDING STRUCTURE AND PRINTER

FIELD

Embodiments described herein relate generally to a core holding structure and a printer.

BACKGROUND

In the field of printers, there is conventionally known a core holding structure in which a roll-shaped core on which a strip-shaped material such as an ink ribbon is wound is held by a rotationally driven take-up shaft.

In the conventional printers, it is desirable to hold the core and prevent any idle rotation of the core when rotating the take-up shaft and winding the strip-shaped material around the core. It is also desirable that the core can be easily detachably mounted to the take-up shaft.

DETAILED DESCRIPTION

According to one embodiment, a core holding structure includes a shaft portion to which a core for winding thereon a strip-shaped material is inserted and by which the core is rotationally driven. A roller is provided on an outer circumferential surface of the shaft portion. The roller is configured to make contact with an inner circumferential surface of the core inserted to the shaft portion and rotate in a direction in which the core is attached to or removed from the shaft portion. The core holding structure further includes an elastic member configured to hold the roller and bias the roller radially outwards from the shaft portion when pressed toward the surface of the shaft portion.

A core holding structure and a printer according to embodiments will now be described in detail with reference to the accompanying drawings. The following description is directed to an application of embodiments to a thermal printer for performing printing on a paper through the use of an ink ribbon which is wound around a core held by a core holding structure.

Figure 1:
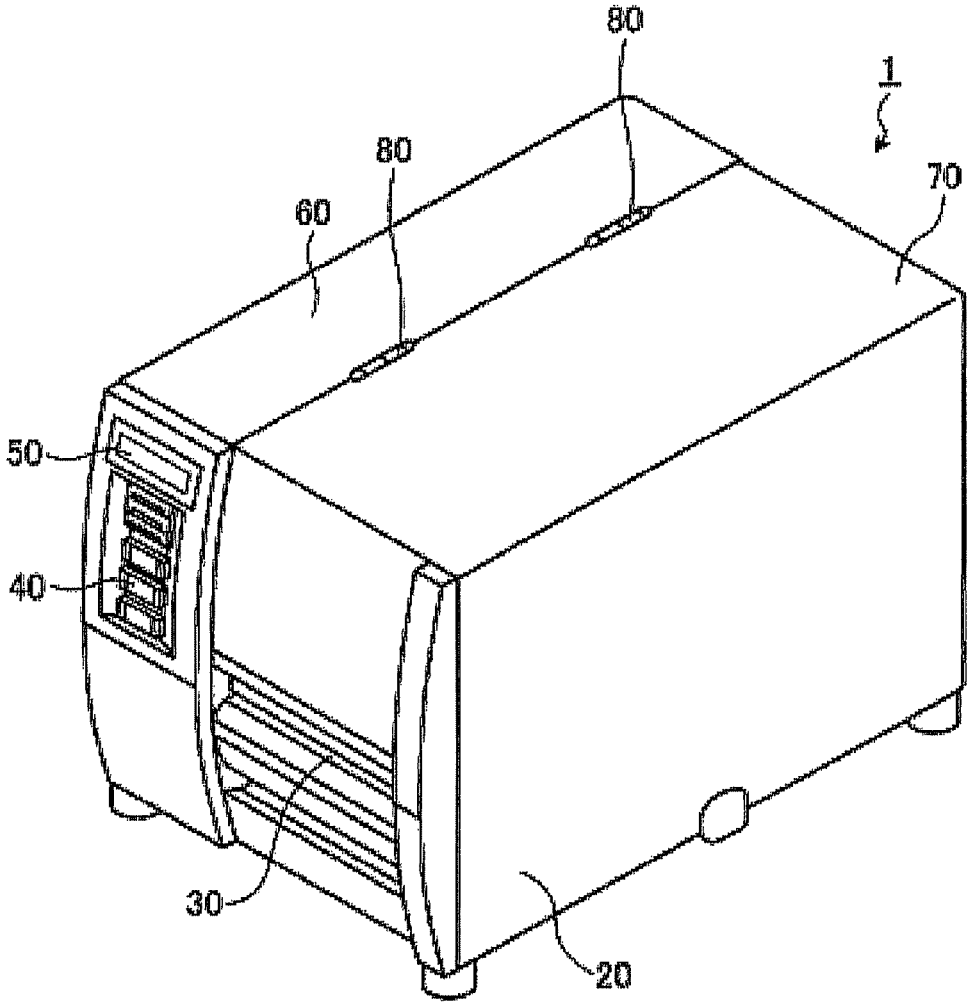
FIG. 1 is a perspective view schematically showing an external appearance of a printer according to one embodiment.

FIG. 1 is a perspective view schematically showing an external appearance of a printer 1 according to one embodiment. As shown in FIG. 1, a paper outlet 30 for discharging a printed paper is formed on the front surface of a housing 20 of the printer 1. On the left surface of the housing 20, a control box 60 is provided and includes different types of operation keys 40 and a display unit 50 such as a liquid crystal display, which are arranged on the front surface of the control box 60. In the control box 60, a control unit (not shown) is provided for controlling the operations of individual units of the printer 1. A cover 70 is attached to the housing 20 so that the cover 70 can rotate upwards about a hinge 80 extending along one edge of the upper surface of the housing 20 near the control box 60. If the cover 70 is rotated upwards and opened, a user can access the internal configuration arranged within the housing 20.

Figure 2:
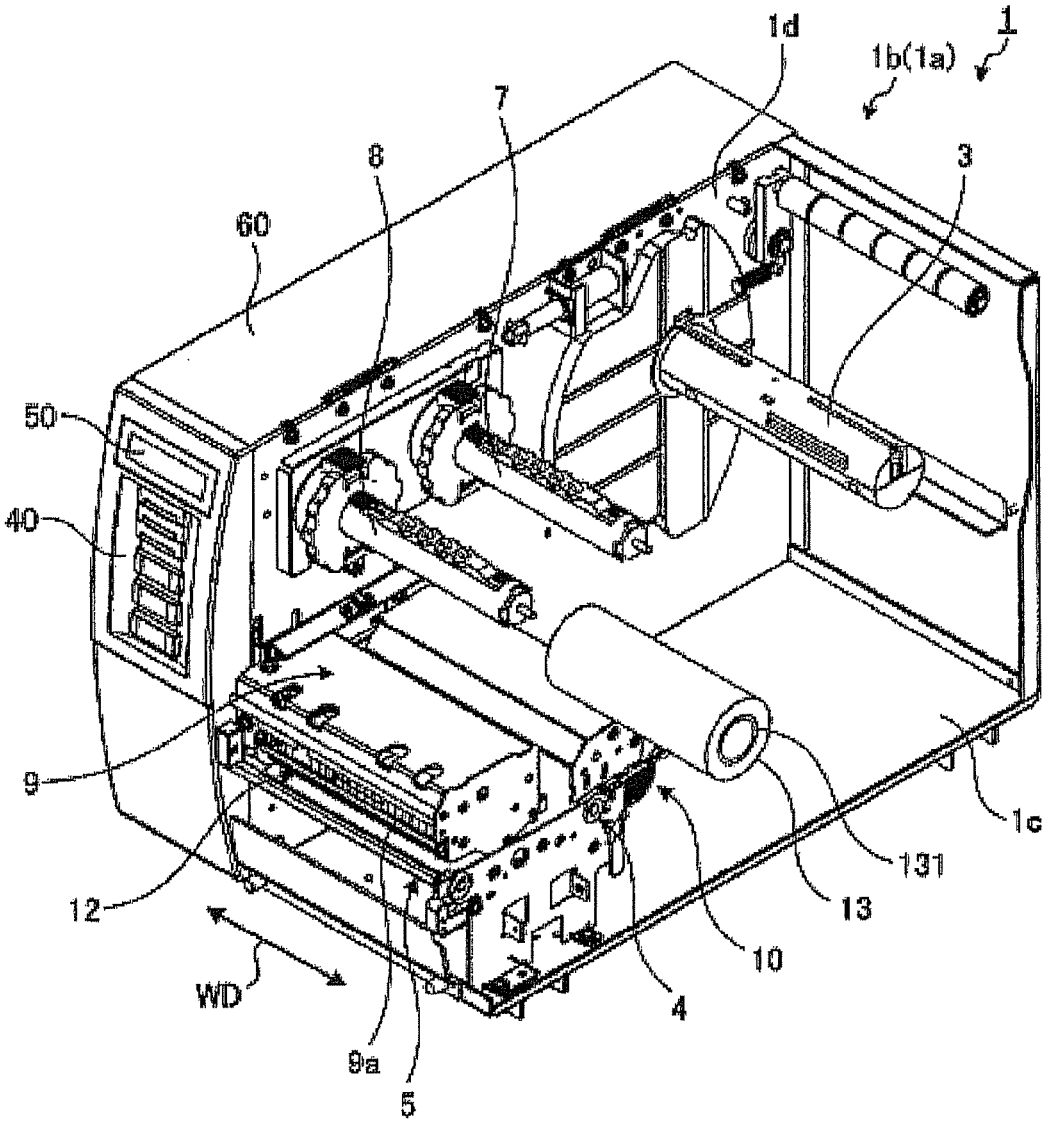
FIG. 2 is a perspective view illustrating one example of an internal configuration of the printer.

FIG. 2 is a perspective view illustrating an exemplary internal configuration of the printer 1. More specifically, FIG. 2 shows the internal configuration of the printer 1, in which the cover 70 is opened and a paper roll 11 (see FIG. 3) and a ribbon roll 13 are not mounted yet.

Figure 3:
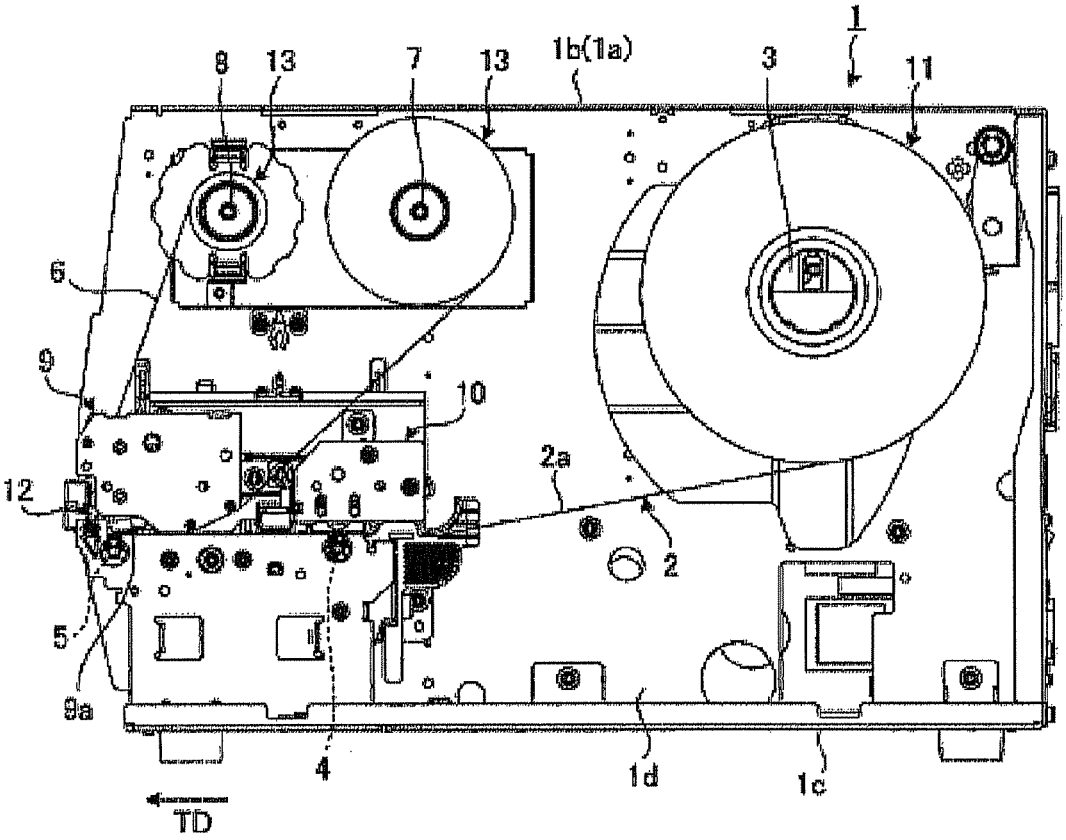
FIG. 3 is a side view illustrating one example of the internal configuration of the printer.

FIG. 3 is a side view of the internal configuration of the printer 1. More specifically, FIG. 3 shows the internal configuration of the printer 1 in which the paper roll 11 and the ribbon roll 13 are mounted for printing operation.

As shown in FIGS. 2 and 3, the printer 1 includes a body unit 1*a*. The body unit 1*a* includes a housing 1*b* composed of a bottom wall 1*c* and a cover 70, and a vertical wall 1*d* arranged inside the housing 1*b* to extend perpendicularly to the bottom wall 1*c*. A paper roll holding shaft 3, a conveying roller 4, a platen roller 5, a supply shaft 7, a take-up shaft 8, a printing block 9 and a pinch roller block 10 are attached to the vertical wall 1*d* in a substantially perpendicular relationship with the vertical wall 1*d*. The control unit set forth above and motors (not shown) for driving the supply shaft 7 and the take-up shaft 8 are accommodated within the control box 60 arranged at the back side of the vertical wall 1*d*.

The paper roll holding shaft 3 holds the paper roll 11 formed by winding a strip-shaped paper 2, so that the paper roll 11 can rotate about an axis perpendicular to the plan view of FIG. 3. While the paper roll holding shaft 3 is rotatably attached to the vertical wall 1*d* in the present embodiment, the paper roll holding shaft 3 may be configured to be fixed to the vertical wall 1*d* and the paper roll 11 for the strip-shaped paper 2 may be rotatably held on the paper roll holding shaft 3. In the present embodiment, the paper roll holding shaft 3 and the paper roll 11 are not rotationally driven by a motor. In conjunction with the rotation of the conveying roller 4 and the platen roller 5 arranged at the downstream side along a conveying direction TD (at the left side in FIG. 3), the paper roll 11 is rotated (driven) so that the strip-shaped paper 2 can be drawn from the paper roll 11.

The conveying roller 4, the platen roller 5, the supply shaft 7 and the take-up shaft 8 are rotationally driven by motors (not shown). The conveying roller 4 is arranged at the upstream side of the printing unit 12 and the platen roller 5. The pinch roller block 10 includes a pinch roller (not shown) arranged above and near the conveying roller 4 in a parallel relationship with the conveying roller 4. The pinch roller is biased toward the conveying roller 4 under an appropriate biasing force. The strip-shaped paper 2 is interposed between the conveying roller 4 and the pinch roller and is conveyed by the rotation of the conveying roller 4. In the present embodiment, the conveying roller 4, the platen roller 5, the motors (not shown), the motor controller (not shown) and the pinch roller block 10 make up a conveying mechanism.

The supply shaft 7 or the take-up shaft 8 is a rotationally-driven shaft portion to which a ribbon roll 13 is fitted (the details of which will be described later). The ribbon roll 13 is formed by winding a strip-shaped material such as an ink ribbon 6 on a core 131. In the present embodiment, the core 131 is formed into a substantially cylindrical shape having a generally circular cross section. Alternatively, the core 131 may have a cross section of regular octagon shape or other cross-sectional shapes.

A ribbon roll 13 formed by winding an ink ribbon 6 on a core 131 is inserted and set to the supply shaft 7. Another core 131 for winding thereon the ink ribbon 6, which is drawn from the ribbon roll 13 inserted to the supply shaft 7, is inserted and set to the take-up shaft 8. Upon rotation of the take-up shaft 8 driven by a motor, the ink ribbon 6 is drawn from the ribbon roll 13 set to the supply shaft 7 and is wound on the core 131 set to the take-up shaft 8.

When supplied from the supply shaft 7 and taken up by the take-up shaft 8, the ink ribbon 6 and the strip-shaped paper 2 are interposed between the thermal head 9*a* of the printing block 9 and the platen roller 5. While the ink ribbon 6 is interposed between the thermal head 9*a* and the platen roller 5, the ink of the ink ribbon 6 is melted or sublimed as the thermal head 9*a* is heated. Consequently, specified patterns (e.g., text characters, numerals, barcodes or figures) are transferred to and printed on the inner surface 2*a* of the strip-shaped paper 2. In the present embodiment, the thermal head 9*a* and the platen roller 5 make up a printing unit 12 functioning as a printing mechanism for performing printing with the ink ribbon 6 drawn from the rotationally-driven core 131.

Figure 4:
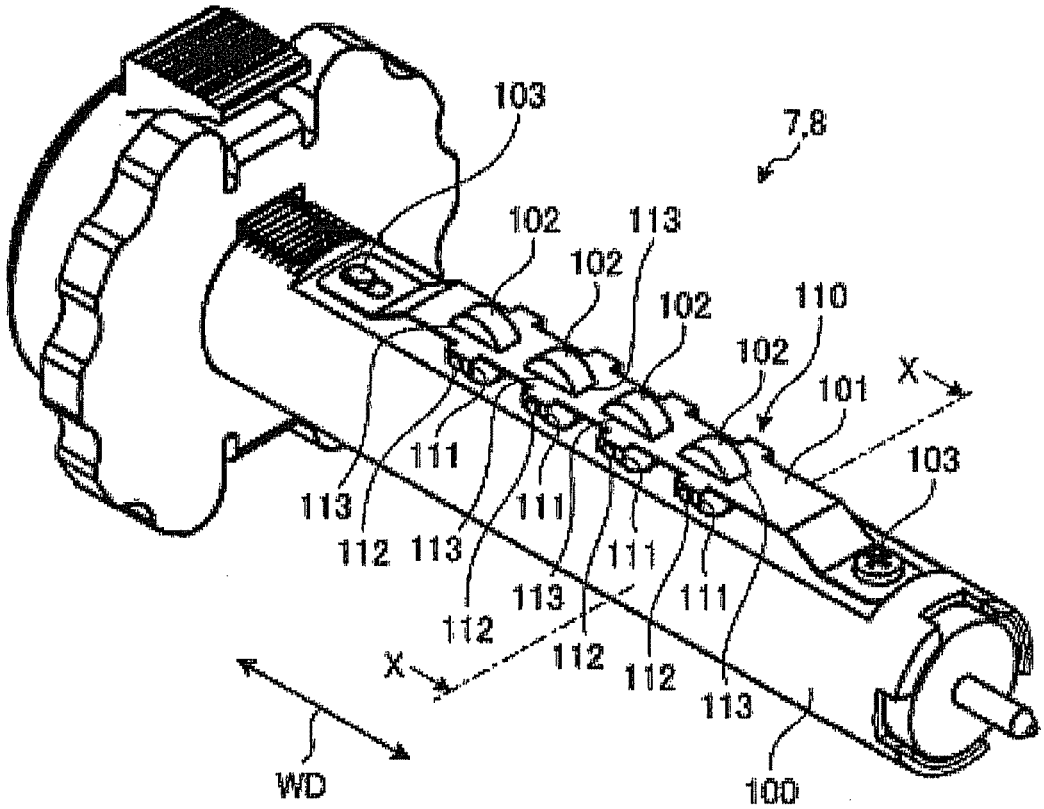
FIG. 4 is a perspective view illustrating an example of a supply shaft or a take-up shaft.
Figure 5:
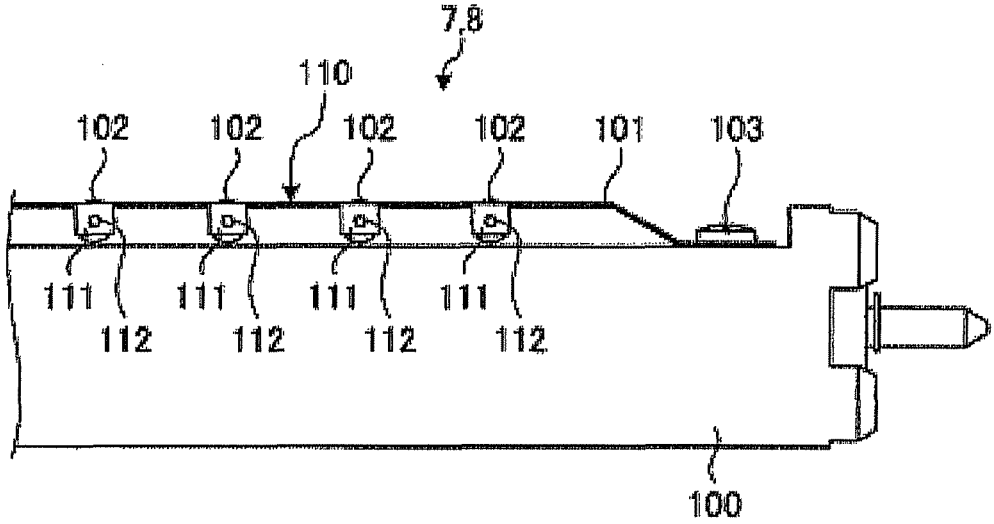
FIG. 5 is a side view illustrating the supply shaft or the take-up shaft.
Figure 6:
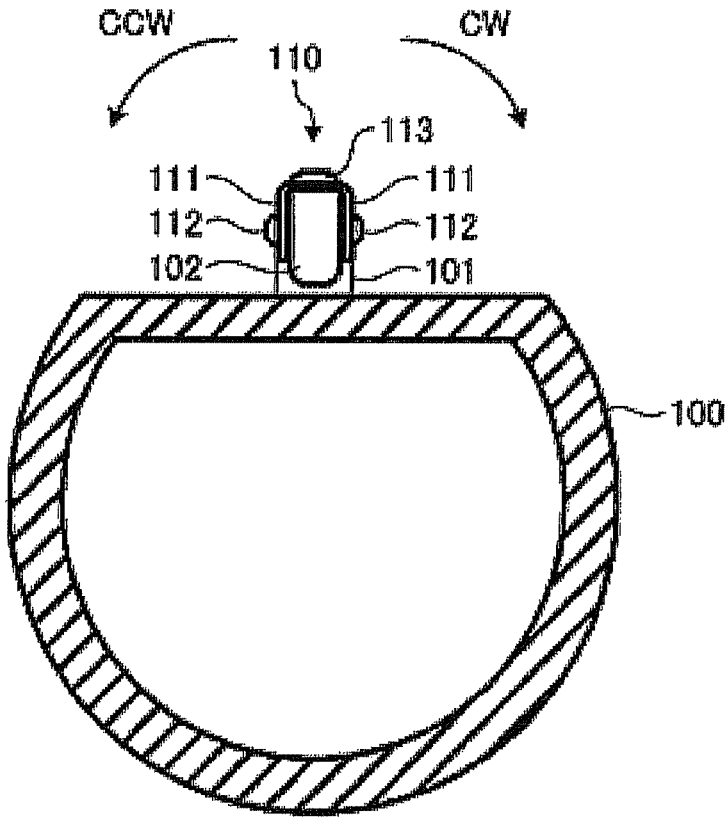
FIG. 6 is a sectional view of the supply shaft, which is taken along line X-X in FIG. 4.
Figure 7:
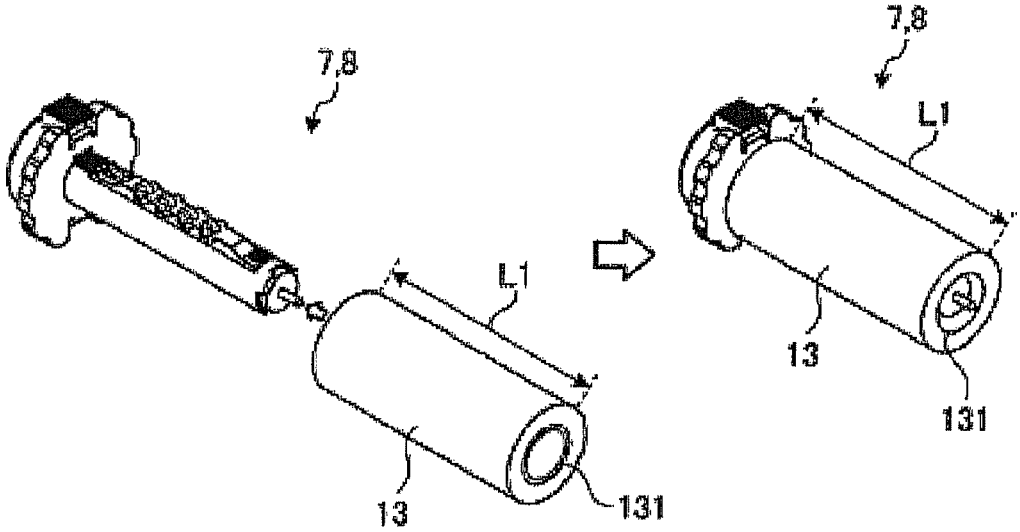
FIG. 7 is a schematic view depicting how to fit a long ribbon roll to the supply shaft or the take-up shaft.
Figure 8:
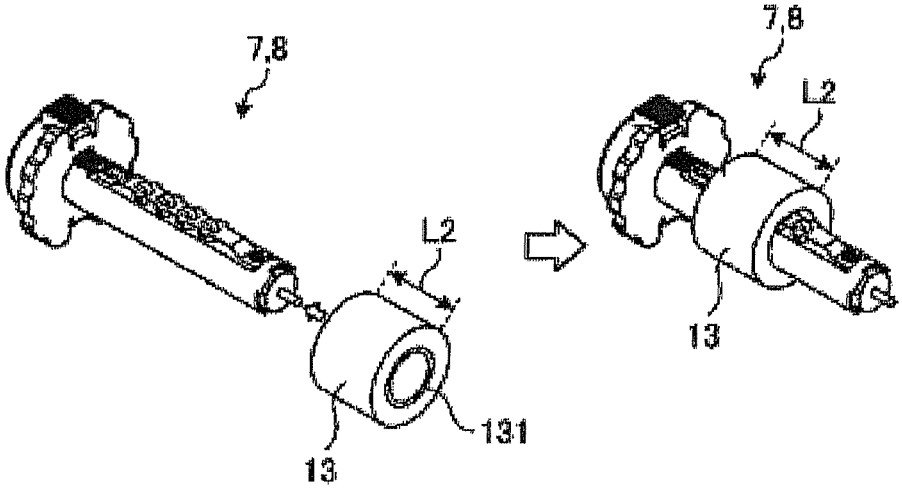
FIG. 8 is a schematic view depicting how to fit a short ribbon roll to the supply shaft or the take-up shaft.

The following is a description on a more detailed configuration of the supply shaft 7 or the take-up shaft 8. FIG. 4 is a perspective view of the supply shaft 7 or the take-up shaft 8. FIG. 5 is a side view of the supply shaft 7 or the take-up shaft 8. FIG. 6 is a sectional view of the supply shaft 7 or the take-up shaft 8, which is taken along line X-X in FIG. 4. FIGS. 7 and 8 schematically illustrate the operations of inserting the ribbon roll 13 to the supply shaft 7 or the take-up shaft 8.

Referring to FIGS. 4, 5 and 6, a leaf spring 101 is provided on an outer circumferential surface 100 of the supply shaft 7 or the take-up shaft 8 configured to be rotationally driven along with the core 131 inserted thereto. The leaf spring 101 is an elastic member configured to apply a biasing force radially outwards from an axis of the shaft when the leaf spring 101 is pressed toward the surface of the supply shaft 7 or the take-up shaft 8. The leaf spring 101 carries a plurality of rollers 102 making contact with an inner circumferential surface of the core 131 inserted and fitted to the supply shaft 7 or the take-up shaft 8. The rollers 102 are configured to rotate in either a direction in which the core 131 is inserted to the supply shaft 7 or the take-up shaft 8, or in a direction in which the core 131 is detached from the supply shaft 7 or the take-up shaft 8. The above configuration makes up a core holding structure of the supply shaft 7 or the take-up shaft 8, including the rollers 102 for making contact with the inner circumferential surface of the inserted core 131 and the leaf spring 101 for biasing the rollers 102 radially outwards from the axis of the shaft.

More specifically, the leaf spring 101 is arranged on the outer circumferential surface 100 to extend in a width direction WD of the supply shaft 7 or the take-up shaft 8. The two opposite ends of the leaf spring 101 are fixed to the outer circumferential surface 100 by fasteners 103. The leaf spring 101 includes a raised portion 110 formed over a specified length of the leaf spring 101. The raised portion 101 is configured to be biased radially outwards from the shaft 7 or 8 when it is pressed toward to the shaft 7 or 8.

Plural pairs of bent portions 111, each of which is bent substantially in a vertical direction toward the outer circumferential surface 100, are formed in the raised portion 110 at specified intervals along the width direction WD. In particular, each pair of bent portions 111 is positioned at the front and rear sides of the raised portion 110 when it is viewed in FIGS. 4 and 5, while the same pair of bent portions 111 are positioned at the left and right sides of the raised portion 110 when it is viewed in FIG. 6. Each roller 102 is attached to the corresponding pair of the bent portions 111 by a fastener 112, such that the rollers 102 can rotate in the width direction WD without making contact with the outer circumferential surface 100. In the above configuration, the rollers 102 are arranged in plural numbers along the width direction WD of the supply shaft 7 or the take-up shaft 8.

The rollers 102 partially protrude radially outwards from the raised portion 110 through holes 113 formed in the raised portion 110, in which the holes are positioned in alignment with the bent portions 111. Accordingly, when the core 131 is attached to or detached from the supply shaft 7 or the take-up shaft 8, the portions of the rollers 102 protruding from the raised portion 110 make contact with the inner circumferential surface of the core 131, such that the rollers 102 can be rotated (or driven) in conjunction with the movement of the core 131. The height of the raised portion 110 with respect to the outer circumferential surface 100 is determined such that, when the core 131 is inserted to the supply shaft 7 or the take-up shaft 8, the rollers 102 do not make contact with the surface of the outer circumferential surface 100.

Therefore, as noted in FIGS. 7 and 8, the frictional force between the core 131 of the ribbon roll 13 and the supply shaft 7 or the take-up shaft 8 can be reduced by the rotation of the rollers 102 that makes contact with the core 131 when the core 131 is inserted and fitted to the supply shaft 7 or the take-up shaft 8. This facilitates smoothly inserting the core 131 to the supply shaft 7 or the take-up shaft 8. Since the rollers 102 are arranged in plural numbers along the width direction WD, any core 131 with different widths can make contact with at least a portion of the rollers 102. For example, a ribbon roll 13 with a larger width L1 (see FIG. 7) may be in contact with a greater number of the rollers 102 while another ribbon roll 13 with a smaller width of L2 may be in contact with a less number of the rollers (see FIG. 8). This configuration ensures that the frictional force applied against the core 131 is reduced.

The core 131 fitted to the supply shaft 7 or the take-up shaft 8 is supported by the rollers 102 pushed radially outwards by the biasing force of the leaf spring 101. As shown in FIG. 6, the rollers 102 rotate in conjunction with the movement of the core 131 being inserted or detached in the width direction WD. Even in such case, the rollers 102 do not rotate in any rotational direction (either clockwise CW or counterclockwise CCW) of the supply shaft 7 or the take-up shaft 8. Accordingly, when the ink ribbon 6 is wound on the core 131 by rotating the supply shaft 7 or the take-up shaft 8, an idle rotation of the core 131 along the shaft 7 or 8 can be prevented. To reinforce such effect of preventing idle rotation, the rollers 102 may be made of a material with high frictional coefficient, e.g., rubber.

While the present embodiment has been described by taking as an example a configuration in which one leaf spring 101 is provided on the outer circumferential surface 100, a plurality of leaf springs 101 may be arranged on the outer circumferential surface 100. For example, another leaf spring having a plurality of rollers may be provided at the opposite side across the shaft axis from the leaf spring 101 shown in FIG. 6.

While the present embodiment has been described by taking as an example a configuration in which a plurality of rollers 102 are provided in the leaf spring 101, the present disclosure is not limited thereto. Alternatively, only one roller may be provided in the leaf spring 101.

In the present embodiment, both the supply shaft 7 and the take-up shaft 8 are provided with the core holding structure.

However, only the take-up shaft 8 may be provided with the core holding structure if the supply shaft 7 and the take-up shaft 8 are rotationally driven only in the direction in which the ink ribbon 6 is drawn from the supply shaft 7.

In the present embodiment, the supply shaft 7 and the take-up shaft 8 for holding the ribbon roll 13 formed by winding the ink ribbon 6 are provided with the core holding structure. However, the paper roll holding shaft 3 for holding the paper roll 11 formed by winding the strip-shaped paper 2 as a strip-shaped material may also be provided with the core holding structure. For example, in the configuration in which the paper roll holding shaft 3 is rotationally driven by a motor to rewind the unwound strip-shaped paper 2, the paper roll holding shaft 3 may be provided with the core holding structure described above.

While certain embodiments have been described, these embodiments have been presented by way of example only, and are not intended to limit the scope of the inventions. Indeed, the novel core holding structure and printer described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A core holding structure, comprising:

a shaft portion in which a core for winding thereon a strip-shaped material is inserted and by which the core is rotationally driven;

a roller provided on an outer circumferential surface of the shaft portion, the roller configured to make contact with an inner circumferential surface of the core inserted in the shaft portion and rotate in a direction in which the core is attached to or detached from the shaft portion; and an elastic member configured to hold the roller and bias the roller radially outwards from the shaft portion when the elastic member is pressed toward the surface of the shaft portion.

2. The structure of claim 1, wherein the roller includes a plurality of rollers arranged along a width direction of the shaft portion.

3. The structure of claim 2, wherein the elastic member is a leaf spring including a raised portion partially protruding radially outwards from the shaft portion, the raised portion extending in the width direction of the shaft portion, the plurality of rollers arranged in the raised portion not making contact with the outer circumferential surface of the shaft portion.

4. The structure of claim 1, wherein the strip-shaped material is an ink ribbon.

5. The structure of claim 1, wherein the roller is made of a material with a high frictional coefficient.

6. A printer, comprising:

a shaft portion in which a core for winding thereon a strip-shaped material is inserted and by which the core is rotationally driven;

a roller provided on an outer circumferential surface of the shaft portion, the roller configured to make contact with an inner circumferential surface of the core inserted in the shaft portion and rotate in a direction in which the core is attached to or detached from the shaft portion;

an elastic member configured to hold the roller and bias the roller radially outwards from the shaft portion when the elastic member is pressed toward the surface of the shaft portion; and a printing mechanism configured to perform printing on the strip-shaped material drawn from the rotationally driven core.

7. The printer of claim 6, wherein the roller includes a plurality of rollers arranged along a width direction of the shaft portion.

8. The printer of claim 7, wherein the elastic member is a leaf spring including a raised portion partially protruding radially outwards from the shaft portion, the raised portion extending in the width direction of the shaft portion, the plurality of rollers arranged in the raised portion not making contact with the outer circumferential surface of the shaft portion.

9. The printer of claim 6, wherein the strip-shaped material is an ink ribbon.

10. The printer of claim 6, wherein the roller is made of a material with a high frictional coefficient.

* * * * *